US005190296A

United States Patent [19]

Sainsbury

[11] Patent Number: 5,190,296

[45] Date of Patent: Mar. 2, 1993

[54] MEMORY GAME

[76] Inventor: J. Douglas Sainsbury, P.O. Box 988, Thornhil, Toronto, Ontario, Canada, L3T 4A5

[21] Appl. No.: 796,787

[22] Filed: Nov. 25, 1991

[51] Int. Cl.[5] ..... A63F 1/00

[52] U.S. Cl. ..... 273/296; 273/273

[58] Field of Search ..... 273/296, 303-306, 273/292, 273

[56] References Cited

U.S. PATENT DOCUMENTS

| | | | |
|---|---|---|---|
| 698,541 | 6/1902 | Neely | 273/296 |
| 3,603,591 | 9/1971 | Shoptaugh | 273/273 |
| 4,428,582 | 1/1984 | Smith | 273/296 |
| 4,728,108 | 3/1988 | Neuwahl | 273/296 |

*Primary Examiner*—Benjamin H. Layno

[57] ABSTRACT

The present invention relates to a memory game involving cards or playing pieces having different indicia thereon. The playing pieces are supportable on a flat surface to conceal a particular indicia on that surface. The playing pieces are coordinated to have a particular relationship therebetween such that one piece may be desired by more than one player. The particular method of play also requires significant strategy by the players which can be dramatically influenced by the play of others.

11 Claims, 4 Drawing Sheets

FIG. 5.

FIG. 6.

MEMORY GAME

FIELD OF THE INVENTION

The present invention relates to a game and, in particular, relates to a game having a number of playing pieces with different indicia on different faces of the playing pieces, with the game requiring each player to remember certain colour indicia relationships in order to improve the chances of winning.

BACKGROUND OF THE INVENTION

There are a number of memory games which have been proposed, however, in most memory games, the indicia on the playing piece is normally hidden from view. This would be the case with respect to any conventional cards of a playing card deck where the indicia, in that case the particular card, would be face down and the back of all cards are the same. Many card games operate on this principle of having a common back surface and turning over of a particular card to reveal the indicia therebehind. Although such games do test a player's memory and requires concentration to improve their chances of succeeding in the game, there is little strategy involved and a player has access to all of the playing pieces. Unfortunately, with this type of game, the playing pieces may become marked or, in some cases, children who play the game often have prememorized what playing pieces are associated with a particular style card.

With respect to conventional card games, young children can experience difficulty shuffling of the cards, as the cards can become reversed.

There remains a need to provide a memory type game which has some interaction with other players as well as requiring some planning in order to achieve the desired goal.

SUMMARY OF THE INVENTION

Playing pieces of a game, according to the present invention, comprise a plurality of playing pieces, with each playing piece having two faces. The playing piece can be supported on either of the two faces such that when supported, one of the faces is covered. Each of the playing faces has a distinct indicia thereon. The faces of the playing pieces are configured to have a set of first faces and a set of second faces. The set of first faces are grouped into at least four subgroups with each subgroup having a common indicia and having at least four playing pieces. The set of second faces is grouped into at least four subgroups with each subgroup having a common indicia and having at least four playing pieces. The set of first faces and the set of second faces are coordinated such that the indicia of each subgroup of the set of second faces is associated with each subgroup of the set of first faces. In this way, there is an interrelationship of the set of first faces and the set of second faces whereby collection of one particular indicia indicates that there will be competition with indicia of the other set.

According to a preferred aspect of the invention, the set of first faces is grouped into at least six subgroups and the set of second faces is grouped into at least six subgroups, wherein each subgroup has at least six playing pieces. The playing pieces can have different colour field indicia on each face or the indicia could be depictions of objects.

The invention is also directed to a method of playing a game by at least two players by means of playing pieces, with each playing piece having at least two faces with different indicia thereon, only one of which is exposed when the playing piece is supported on a flat surface. The method comprises providing each player with at least four playing pieces with only one face of each player's playing pieces exposed to the players. The remaining playing pieces are placed with only one exposed surface visible in an area available to both players. The players take turns in sequence and each turn comprises turning over any playing piece followed by switching and turning over the playing piece of any playing piece within the player's group having an exposed indicia matching with the exposed indicia of any other playing piece in an effort for a player to have face-up in his group at least four matching indicia. The method of playing the game can be made more difficult by the playing pieces requiring at least twelve different indicia with a player trying to obtain at least six matching indicia.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
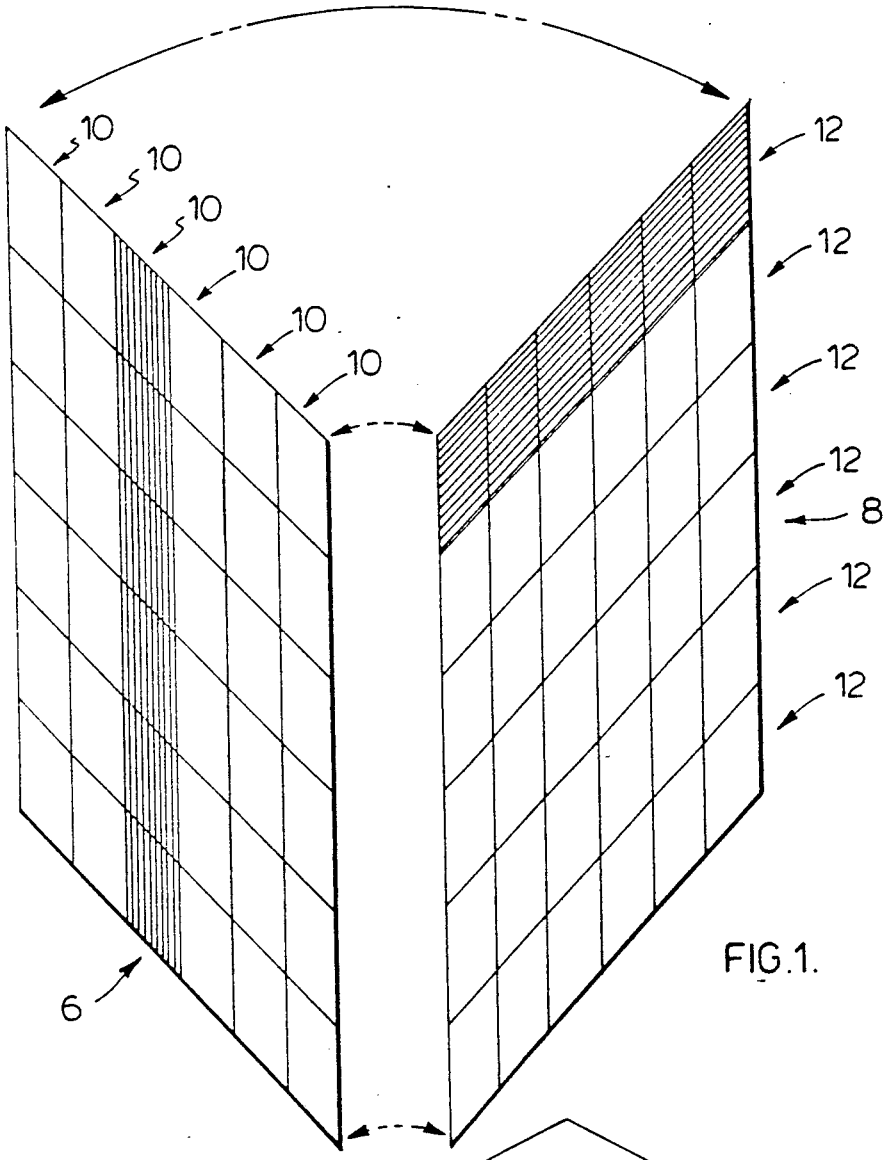
FIG. 1 is a perspective view of a host of cards displaying a set of first indicia and a set of second indicia.

FIG. 1 shows a 6×6 matrix 2 of the top and bottom sides of cards 4 which form a set of first faces 6 and a set of second faces 8. The cards have been positioned in this matrix for illustrative purposes, however, it can be appreciated that they need not be manufactured in this manner. In this case, the set of first faces 6 have six colour fields with each column 10 being a single, distinct colour. Each colour field represents a subgroup and each subgroup has six cards. For example, there are six cards with the colour of column 10*a*. The reverse side of the set of first faces 6 is the set of second set of faces 8. In this case, the cards have been provided with six different and distinct colour fields in each of the six rows 12. In this way, there are twelve distinct subgroups and none of the subgroups are the same. For example, there will not be a set of six cards having a single colour field which also have on the rear surface one common colour field. In fact, the rear surface of these cards would preferably have colour fields from each of the rows 12.

Figure 2:
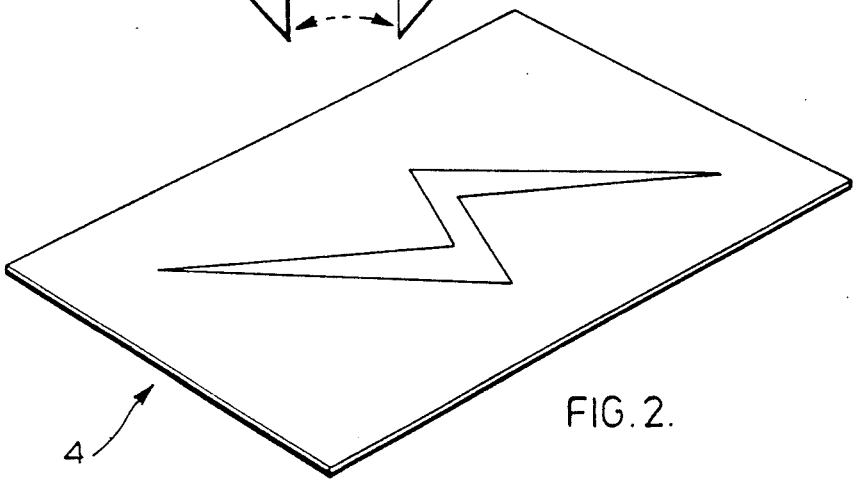
FIG. 2 is a perspective view of a card of FIG. 1 having printed thereon a particular indicia.

The colour fields identified in FIGS. 1 and 2 could be any distinct symbol or field and the object of one of the games could be to collect six cards having the same colour field, symbol, or other field.

Figure 3:
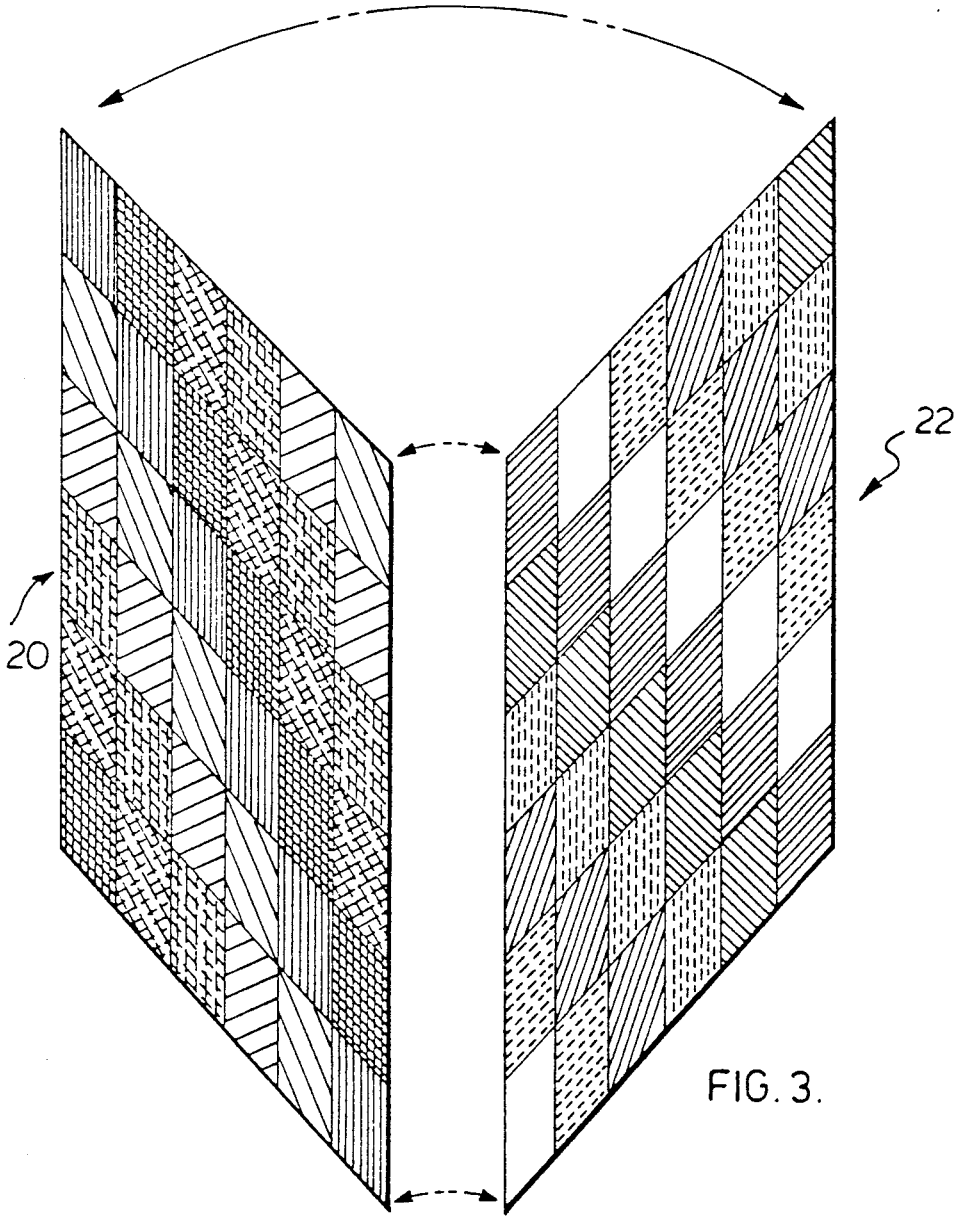
FIG. 3 is a perspective view of cards laid out to include additional sets of indicia.
Figure 4:
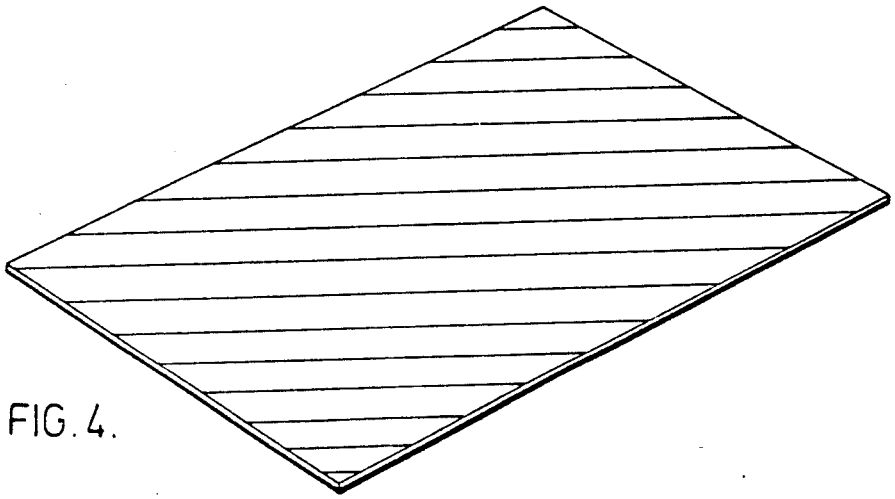
FIG. 4 is a perspective view of one card of FIG. 3.

A third set and fourth set of indicia are shown in FIGS. 3 and 4. In this case, distinct indicia are on diagonals with the diagonals of the third and fourth set being on opposite diagonals. Again, there is no overlap of indicia between the third and fourth sets and there is no overlap with the first and second sets. There is overlap between individual cards of the groups. The indicia of the third and fourth sets could be stripes on the card; they could be geometric shapes, such as diamonds or circles; or could be products of a particular supplier, such as different car models or food products. In any event, each set of faces can be separately identified.

In order to play the game, the cards are shuffled and it should be noted that it does not matter whether one card flips over during the shuffling, as it makes no difference since both sides of the cards will be used in the game. In fact, such reversing of cards actually improves the shuffling action.

Figure 5:
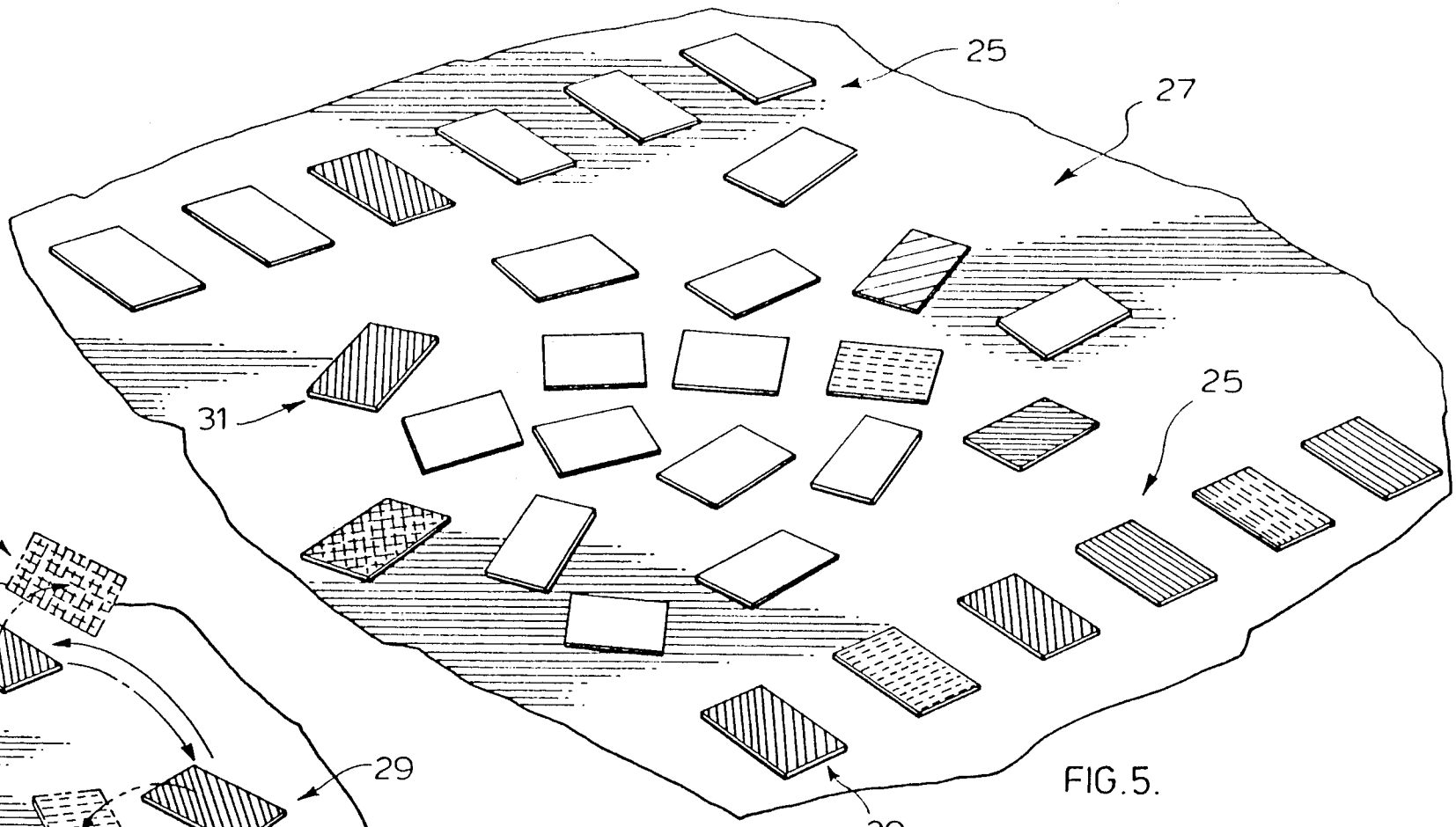
FIG. 5 shows a game arrangement for playing with the cards.
Figure 6:
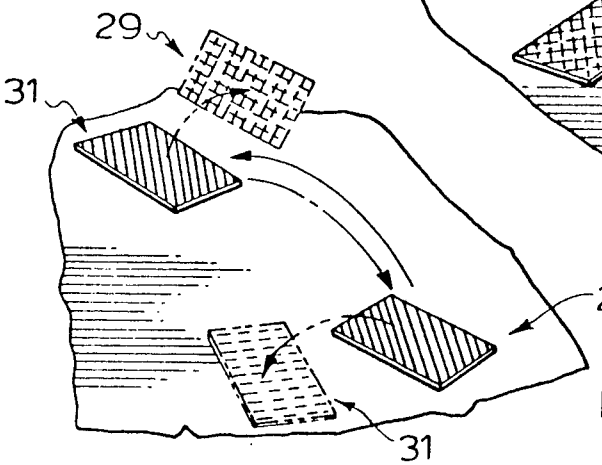
FIG. 6 illustrates the mechanics of a switch and reverse used by a player during his turn.

Once the cards have been shuffled, six cards are distributed to each player and the remaining cards are placed in a center area between the players, as shown in FIG. 5. The players review their own cards, both front and back surfaces, and then place their cards 25 with one surface down in front of them. The players, after they have placed their cards down in front of them are not allowed to look at the hidden surfaces. One player starts his turn and each turn is based on flipping over any card in the game, including both the common cards 27 as well as the individual player cards. The player, after he has carried out a flip, then is entitled to switch any face-up indicia within his group of cards with any other matching face-up indicia on any of the cards in the game. When he determines a switch which is to be made, the switch is completed by reversing each of the cards. This is shown in FIGS. 5 and 6 where card 29 is "switched" with card 31 and each card is turned over as indicated in FIG. 6. Thus, the card that he has desired to match up with is brought back to his own hand and turned over and the card that he has taken from his own hand is placed in the location of the card which he has switched with and the card from his hand is reversed. In this way, the cards which have been switched will each be reversed and will change locations. Once he has completed his turn, the next player repeats the operation. The object of the game is to collect a certain number of identical indicia or indicia related in a particular manner. The game becomes somewhat difficult if the player is required to collect six matching indicia when the cards are from the 6×6 matrix as shown in FIG. 1. As can be appreciated, if player 1 is collecting one particular indicia of the first set of faces 6 and player 2 happens to be collecting a particular indicia of the second set of faces, the players will have a natural conflict with respect to one card which is common to both sets of faces. As the number of players increase, the extent of the conflict or competition for cards increases.

In some embodiments, it may be useful to designate certain indicia as "wild cards" and in this case, a particular indicia of the third or fourth sets could be used to designate a particular wild card.

It is possible with the first and second set of faces shown in FIG. 1 to be colour fields and the third and fourth sets of faces of FIG. 3 to be symbols overlying the colour fields. By using all of the indicia, the game is further complicated whereby one player could be collecting colour field indicia whereas the other player is collecting indicia designated by a symbol. This further complicates the game and allows a player to disguise his particular strategy for collecting of cards.

The game has a certain amount of sophistication to it, in that the player need not show or have face-up the particular cards that he is desiring to collect. For example, when he is first dealt his six cards, he has the option of placing whichever side he wishes face-up. He may therefore wish to bury certain of his cards of a matching indicia so that players are not aware of his strategy for winning the game. He can then reveal these indicia at the particular point by flipping one of the cards within his own hand, as allowed by each turn. The game requires significant concentration, as one is trying to keep track of the particular pairs of colours of a particular card and the location of the card. This becomes a significant problem, as other players are also interacting and removing certain cards and placing them in their hand. Therefore, what was considered to be the particular card that you wanted on your next turn could be rendered redundant due to the play of another player who reverses that card due to a flip or a switch step in their turn. Each player is also trying to determine the strategy of the other players to determine what, if any, conflicts they may have.

This game also lends itself readily to product promotion where the indicia could be, for example, various products of MacDonalds TM such as Big Mac TM, McChicken TM, etc. Any company offering a number of products or services could promote these products or services by selling of games having these particular indicia thereon.

The game has been described with respect to a 6×6 matrix having a first set of faces with six different indicia thereon and six cards having the same indicia, with a back face having a further six indicia and six cards for each indicia (FIG. 1). It can be appreciated that this is the preferred form of the invention, however, the game can be increased in difficulty by increasing the number of matching indicia, for example, a 7×7 matrix having fourteen different indicia or an 8×8 matrix having sixteen different indicia. It is also possible to simplify the game by producing a 5×5, 4×4 or 3×3 matrix with appropriate reduction in the number of indicia and the number of cards of the same indicia. Again, the game has been described with respect to a square matrix, although it would be possible to provide other arrangements which do not follow this precise matrix alignment. This matrix alignment ensures a good distribution of the different indicia, although it is not essential to the present invention and is certainly not essential to the method of playing the game. The game can further be complicated by additional indicia (FIG. 3) printed over the indicia of FIG. 1. This provides additional options or approaches for winning the game.

The invention has been described with respect to cards, but it is apparent other forms of playing pieces can be used. For cards, shuffling is appropriate, whereas for other playing pieces, mixing may be more appropriate.

The playing of FIG. 1 and FIG. 3 could be used as generally described, but in combination with movement about a gameboard. Certain tasks or requirements of the playing pieces could be required by the gameboard prior to advancing, such as collecting a certain group of playing cards having particular indicia, and only be allowed to advance after this has been accomplished.

Figure 7:
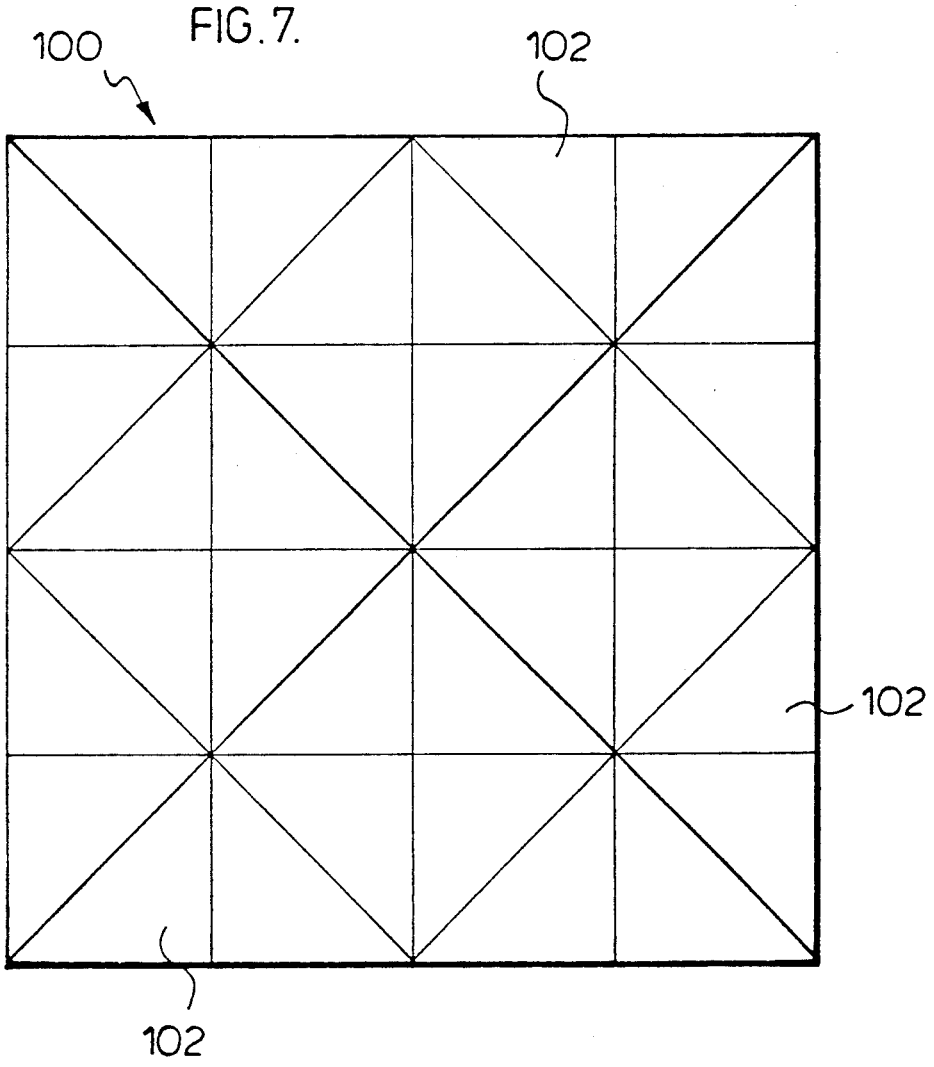
FIG. 7 illustrates a game board.

One such gameboard 100 is shown in FIG. 7. To speed up this game, only 16 cards are used, i.e. eight colours giving eight different coloured sets of four cards. The square board is divided up into 32 triangles 102. It is sectioned off by using the diagonals of the board to give each of the four players a large triangle area in which there are eight coloured smaller triangles that match the sets of colours on the cards. Each player is given eight black triangles that are the same size as the smaller triangles in their playing area. Cards are dealt and using the normal "Flip 'n Switch" rules, a player tries to collect four cards of the same colour. Once a player has managed to do this, they are permitted to cover up that colour in their area with a black triangle. The game continues until a player has collected the eight coloured sets and "blacked" out their section of the board.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. Playing pieces of a game comprising a plurality of playing pieces, each playing piece having two faces each of which can act as a support surface for said playing piece and which includes on each face a visually distinct indicia which is hidden when the respective playing piece is supported on the respective face;

said faces of said playing pieces being configured to have a set of first faces and a set of second faces, said set of first faces being grouped into at least 6 subgroups with each subgroup having a common visually distinct indicia and having at least 6 playing pieces;

said set of second faces being grouped into at least 6 visually distinct subgroups with each subgroup having a common visually distinct indicia and having at least 6 playing pieces;

said set of first faces and said set of second faces being coordinated such that said visually distinct indicia of each subgroup of said set of second faces is paired to form single playing pieces with each visually distinct indicia of the subgroups of said set of first faces and wherein said indicia are different colour fields.

2. Playing pieces as claimed in claim 1 wherein said playing pieces are cards.

3. Playing pieces as claimed in claim 1 wherein colour fields cover one entire face of a card.

4. A method of playing a game by at least two players by means of playing pieces with each playing piece having at least two faces with different indicia thereon only one of which is exposed when the playing piece is supported on a flat surface, said method comprising providing each player with at least 4 playing pieces with one face of each player's playing pieces exposed to the players, placing the remaining playing pieces with only one exposed surface in an area available to both players, said players taking turns in sequence and each turn comprising turning over any playing piece followed by switching and reversing the playing of any playing piece within the player's group having an exposed indicia matching with the exposed indicia of any other playing piece in an effort for a player to have face up in his group at least 4 indicia having a predetermined relationship.

5. A method as claimed in claim 4 wherein the predetermined relationship includes matching indicia.

6. A method as claimed in claim 4 wherein there are at least 36 playing pieces having 12 different groups of indicia with each group having six matching faces on six different faces and wherein each player is initially provided with six playing pieces.

7. A method as claimed in claim 6 wherein each player is trying to win the game by providing in his playing pieces six matching indicia.

8. A method as claimed in claim 7 wherein a player wins the game by having six matching indicia face up in the player's group.

9. A method as claimed in claim 6 wherein the playing pieces used in said method are cards.

10. A method as claimed in claim 9 wherein the indicia are different colour fields on each face.

11. A method as claimed in claim 10 wherein each colour field covers one entire face of a card.

* * * * *